United States Patent [19]

Boyd

[11] 3,967,333

[45] July 6, 1976

[54] BABY FEEDING DEVICE

[75] Inventor: Mervin S. Boyd, Scarborough, Canada

[73] Assignees: Lawrence Peska Associates, Inc., New York, N.Y.; Allan Krystie, Agincourt, Canada; part interest to each

[22] Filed: Nov. 29, 1974

[21] Appl. No.: 528,255

[52] U.S. Cl. ..... 5/317 R; 248/103

[51] Int. Cl.[2] ..... A47C 21/00

[58] Field of Search ..... 248/102–104; 5/317 R

[56] References Cited

UNITED STATES PATENTS

| | | | |
|---|---|---|---|
| 2,391,264 | 12/1945 | Nickelson | 248/103 |
| 2,917,104 | 12/1959 | Cottle | 5/310 X |
| 2,979,282 | 4/1961 | Barecki | 297/388 X |
| 3,105,976 | 10/1963 | Roche | 5/310 X |
| 3,777,673 | 12/1973 | Blazey et al. | 5/93 R |

*Primary Examiner*—Paul R. Gilliam
*Assistant Examiner*—Andrew M. Calvert
*Attorney, Agent, or Firm*—Richard E. Nanfeldt

[57] ABSTRACT

A baby feeding device allows the bottle feeding of a baby without the constant attention of the mother. The baby feeding device comprises: a bed having a mattress, a bottle holding device communicating with the bed, a mechanism for tilting the bed, and a safety belt for holding the baby in a fixed position on the mattress. The bed consists of a one piece plastic molded body having four telescopic legs. The one piece molded body can also be used as a bath tub. The mattress has a horizontally placed section with an upwardly inclined end section.

3 Claims, 4 Drawing Figures

BABY FEEDING DEVICE

SUMMARY OF THE INVENTION

My invention relates to a unique and novel device for feeding a baby, wherein the constant attention of the mother is not required.

A plurality of U.S. Pat. Nos. 3,251,626; 3,289,986; 3,298,649; and 3,584,818 for baby feeding devices are non-related to my present invention.

An object of my present invention is to provide a means for feeding a bottle to a baby laying in a bed.

A further object of my present invention is to provide a bed unit that also functions as a bath tub.

A still further object of my present invention is to provide a mattress that confines the baby to the center of the mattress, wherein the baby's head is tilted upward.

Another object of my present invention is to provide a means whereby the head end of the bed can be tilted upward.

Briefly, my present invention comprises: a bed having a mattress, a bottle holding device communicating with the bed, a mechanism for tilting the bed, and a safety belt for holding the baby in a fixed position on the mattress. The bed consists of a one piece plastic molded body having four telescopic legs. The one piece molded body can also be used as a bath tub. The mattress has a horizontally placed section with an upwardly inclined end section.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
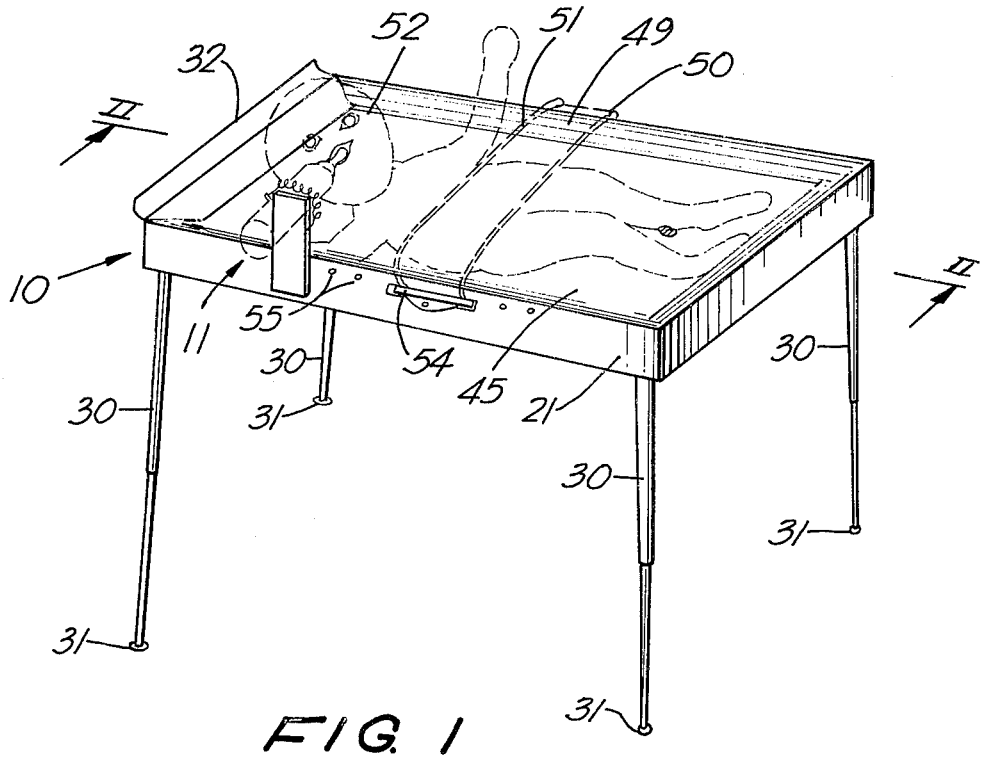
FIG. 1 illustrates a front perspective view of the baby feeding bed.
Figure 2:
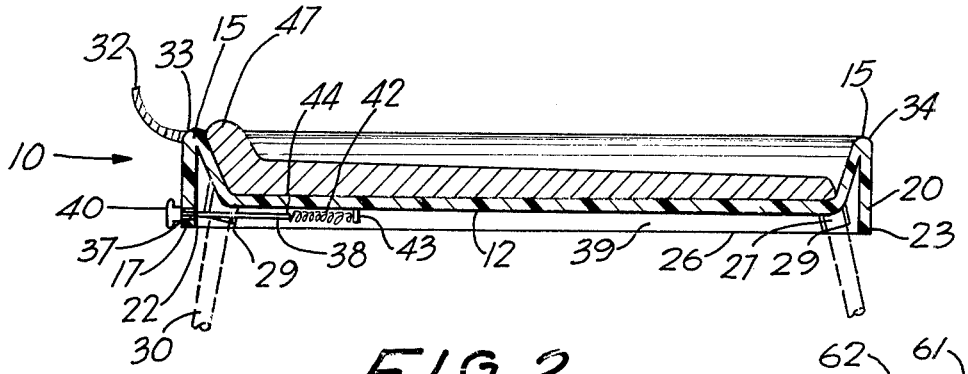
FIG. 2 illustrates a side cross-sectional view of the baby feeding bed.
Figure 4:
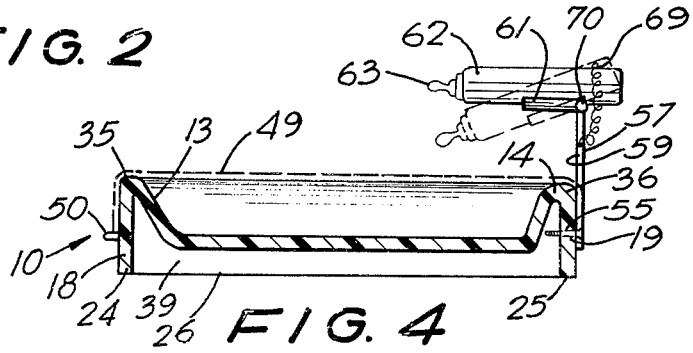
FIG. 4 illustrates a front view of the bottle holding device.

Turning now descriptively to the drawings, in which similar reference characters denote similar elements throughout the several views, FIGS. 1, 2, 4 show a baby feeding bed 10 used to feed a baby laying in the bed 10, wherein the feeding process does not require the constant attention of the mother. The baby feeding bed 10 comprises a main body 11 formed from a single molded light weight plastic piece. The body 11 has a flat horizontally placed bottom base 12 with 45 degree beveled upward extending sidewalls 13, 14 and end walls 15, 16. A rectangular shaped facing 21 communicates with the top edges 33–36 of the sidewalls 13, 14 and end walls 15, 16, wherein the sidewall portions 18, 19 of facing and endwall portions 17, 20 of the facing 21 extend vertically downward. The bottom edges 22–25 of the sidewall portions 18, 19 and end wall portions 17, 20 of facing 21 extend below the horizontal plane of the bottom base 12. A horizontally placed board 26 communicates between the bottom edges 22–25 of the facing 21 forming a chamber 39 between the board 26 and the base 12. A sleeve bracket 27 is affixed to each bottom corner 28 of base 12. The board 26 has four openings 29 therethrough, wherein each opening 29 is vertically aligned with a sleeve bracket 27. A two sectional telescopic leg assembly 30 having a bottom base foot member 31 is slidably mounted within each bracket 27, wherein one leg assembly 30 passes downward through each opening 29 of board 26. A concave upward extending shelf 32 is affixed along the top edge 33 of the end wall 15 of body 11. The bed tilting mechanism comprises the end wall portion 17 of facing 21 having an aperture 37 therethrough, wherein a horizontally placed plunger rod 38 is slidably contained within aperture 37. A knob handle 40 affixed to an outer end 41 of rod 38. The inner end 44 of rod 38 is positioned within chamber 39, wherein a spring assembly 42 with an end attached vertical plate 43 cooperates with the inner end 44 of rod 38. As rod 38 is pushed inward into chamber 39, plate 43 engages base 12 of body 11 causing the end wall 15 of body 11 to lift vertically upward while the foot end 16 of the body 11 remains stationary. The mattress 45 inserts into the body 11, wherein the mattress 45 comprises a horizontally placed section 46 and a head end section 47 inclined upwardly from section 46. Section 46 is of a concave configuration permitting the baby 52 to be kept in a center fixed position on the mattress 45. A retractable belt 49 is contained on a cylindrical reel assembly 50, wherein assembly 50 is affixed to a first sidewall portion 18 of facing 21. The belt 49 is pulled across the open top of the body 11 engaging the belly 51 of the baby 52. The free end 53 of the belt 49 is clamped to a second sidewall portion 19 of facing 21 by means of a clamp assembly 54. A plurality of peg apertures 55 are horizontally aligned on sidewall portion 19 between the head end 15 and clamp assembly 54.

Figure 3:
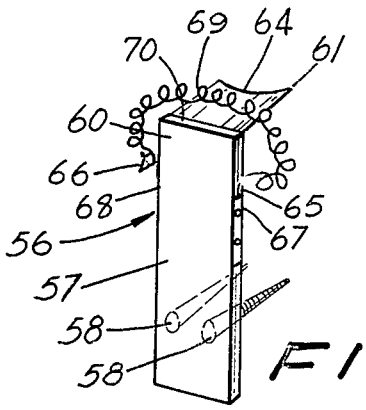
FIG. 3 illustrates an end cross-sectional view of the baby feeding bed.

FIGS. 3, 4 show a bottle holding device 56 consisting of a vertically placed rectangular board 57 having two pegs 58 affixed perpendicularly to a bottom portion of a first longitudinal face 59 of the board 57. The pegs 58 insert into two apertures 55, wherein face 59 engages sidewall portion 19 of facing 21. The upper end 60 of board 57 extends above the top edge 36 of the body 11. A self locking hinge assembly 70 joins a smaller rectangular shaped board 61 having a longitudinal concave curvative 64 with upper end 60 of board 57, wherein board 61 can be angled downward at any desired acute angle to board 57. The baby's bottle 62 with end nipple 63 lays within the longitudinal concave curvative 64 of board 61, wherein the nipple end 72 of the bottle 62 is directed inward towards the body 52. The ends 65, 66 of a coil spring 69 are affixed to the lateral sidewalls 67, 68 of board 57. The spring 69 loops over the bottle 62, thereby securing firmly the bottle 62 to board 61.

Referring back to FIG. 1, the one piece molded plastic body 11 can also be used as a bath tub.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A baby feeding bed, which comprises:

a. a one piece plastic molded body having a bottom base, two upwardly extending sidewalls and two upwardly extending end walls joined to said bottom base, said sidewalls and said end walls joined at beveled angles to said bottom base, one said end wall of said facing having an aperture therethrough;

b. rectangularly shaped facing, said facing joined to the top edges of said sidewalls and said endwalls, said facing extending vertically downward below a horizontal plane of said bottom base;

c. a horizontally placed board, said horizontally placed board joined to the bottom edges of said rectangularly shaped facing, said board having four opening therethrough;

d. four sleeve brackets, one said sleeve bracket affixed to a bottom corner of said bottom base, one said sleeve bracket vertically aligned with each said opening;

e. a two sectional telescopic leg assembly having a bottom base foot memberly slidably mounted in each said sleeve bracket, each said leg assembly extending through one of said openings in said horizontally placed board;

f. a horizontally placed plunger rod slidably contained within said aperture of said facing;

g. a knob handle affixed to an outer end of said plunger rod;

h. a spring assembly affixed to an inner end of said plunger rod between said horizontally placed board and said bottom base of said body;

i. a vertically placed plate affixed to said spring assembly, said plate engaging said base of said body upon inward movement of said plunger rod causing said one end wall of said body to left vertically upward while another end of said body remains stationary;

j. a mattress inserting into said body;

k. a cylindrical reel assembly affixed to a first sidewall portion of said facing;

l. a belt having a free end communicating with said cylindrical reel assembly, said belt adapted to engage a baby laying on said mattress;

m. a clamp assembly affixed to a second sidewall portion of said facing said clamp assembly engaging said free of said belt;

n. a bottle holding device communicating with said bed, said bottle device adapted to hold a bottle therein.

2. A baby feeding bed as recited in claim 1, wherein said bottle holding device further comprises:

a. a vertically place rectangularly shaped board;

b. two pegs affixed perpendicularly to said vertically placed rectangularly shaped board, said pegs inserting into horizontally aligned apertures in said second sidewall portion of said facing, an upper end of said vertically placed rectangularly shaped board extending above said body of said bed;

c. a smaller rectangularly shaped board having a concave curative, said bottle adapted to rest in said concave curative;

d. a self locking hinge assembly joining said upper end of said vertically placed board to an end of said horizontally placed board;

e. a coil spring, the ends of said coil spring affixed to said vertically placed board, said coil spring adapted to engage onto said bottle.

3. A baby feeding device as recited in claim 1, wherein said mattress further comprises:

a. a horizontally placed section;

b. a head end section inclined upwardly from said horizontally placed section; and c. said horizontally placed section having a concave configuration.

* * * * *